US006471623B1

(12) United States Patent
Lin

(10) Patent No.: US 6,471,623 B1
(45) Date of Patent: Oct. 29, 2002

(54) PUSH-UP EXERCISE HOLDER

(75) Inventor: I Shun Lin, Chung Li (TW)

(73) Assignee: U2ID Incorporated (TW)

( * ) Notice: Subject to any disclaimer, the term of this patent is extended or adjusted under 35 U.S.C. 154(b) by 0 days.

(21) Appl. No.: 09/679,533

(22) Filed: Oct. 6, 2000

(51) Int. Cl.[7] ..... A63B 26/00
(52) U.S. Cl. ..... 482/141
(58) Field of Search ..... 482/141, 44, 46, 482/45, 37, 148, 130, 35, 36, 49, 50, 121, 126–128, 79, 82

(56) References Cited

U.S. PATENT DOCUMENTS 911,925 A * 2/1909 Zeno ..... 482/141
1,761,109 A * 6/1930 Dietz ..... 482/141
2,259,653 A * 10/1941 Mitchell ..... 72/136
2,782,033 A * 2/1957 Ugartechea ..... 272/67
3,115,338 A * 12/1963 Acs et al. ..... 272/57
3,465,750 A * 9/1969 Schawalder ..... 128/57
3,686,703 A * 8/1972 Ray ..... 15/235.4
4,310,154 A * 1/1982 Kauffman ..... 272/67
4,351,525 A * 9/1982 Rozenblad ..... 272/93
4,684,125 A * 8/1987 Lantz ..... 482/112
4,768,778 A * 9/1988 Thomas, Jr. ..... 482/141
4,836,531 A * 6/1989 Niks ..... 482/44
5,181,897 A * 1/1993 Agan ..... 482/141
5,205,802 A * 4/1993 Swisher ..... 482/141
5,425,690 A * 6/1995 Chang ..... 482/46
5,466,206 A * 11/1995 Fleming ..... 482/121

* cited by examiner

*Primary Examiner*—Michael A. Brown
*Assistant Examiner*—Lori Baker Amerson
(74) *Attorney, Agent, or Firm*—Troxell Law Office PLLC

(57) ABSTRACT

A push-up exercise holder. The holder includes a seat, a lever that is pivotally installed on the holder, and an elastic buffer element is installed between the seat and the lever. A holding portion of the lever is elevated and positioned on the seat, and a notch is formed between the lever and seat so that as the push-up exercise holder is held, it generates a buffer effect with upward and downward movement of a body.

3 Claims, 5 Drawing Sheets

PUSH-UP EXERCISE HOLDER

FIELD OF THE INVENTION

The present invention relates to a push-up exercise holder, and especially to a holder with a better buffer effect, thereby, as the push-up exercise holder is held by the user, it generates a buffer effect with upward and downward movements of a body.

BACKGROUND OF THE INVENTION

The modern peoples become fatter due to enriched food supply. In the busy life, many people sleep in the holidays without engaging any outdoor activity. Therefore, some exercising devices become more and more popular. The popular exercising devices, such as those used in running, muscle training, massaging, or fat reduction, are designed for different exercises.

A simple exercise indoors is the push-up exercise. It can be realized at leisure time easily. However, this exercise has no assistant device for a long time so that it becomes a dull action. Therefore, a prior art device assisting the push-up exercise is developed. This prior art design has a ⊓ shape body with two ends. The bottom of the two ends are added with respective short transverse rods for enlarging the area in the bottom so that it is steady, and the middle section is elevated. Therefore, a frame is formed. By this prior art, the holder is elevated from the ground with a height. Therefore, it is not used in the push-up exercise, but also can be used to support the hands while the user has a pose of sitting like one sitting on a saddle.

However, this prior art has a fixing structure. The holding lever is too hard without elasticity so that no buffer effect and a good touch feeling induce as the user is used. Moreover, the appearance and shape are too dull so not to satisfy the requirement of the consumers.

SUMMARY OF THE INVENTION

Accordingly, the primary object of the present invention is to provide a push-up exercise holder, as the push-up exercise holder is held in hand, it generates a buffer effect with upward and downward movement of a body.

To achieve the aforesaid object, the present invention provides a push-up exercise holder mainly comprising a seat, a lever pivotally installed thereon, and an elastic buffer element installed between the seat and the lever. A holding portion of the lever is elevated and positioned on the seat, and a notch is formed between the lever and seat so that as the push-up exercise holder is held, it generates a buffer effect with upward and downward movement of a body.

The various objects and advantages of the present invention will be more readily understood from the following detailed description when reading in conjunction with the appended drawing.

DETAILED DESCRIPTION OF THE PREFERRED EMBODIMENTS

Figure 1:
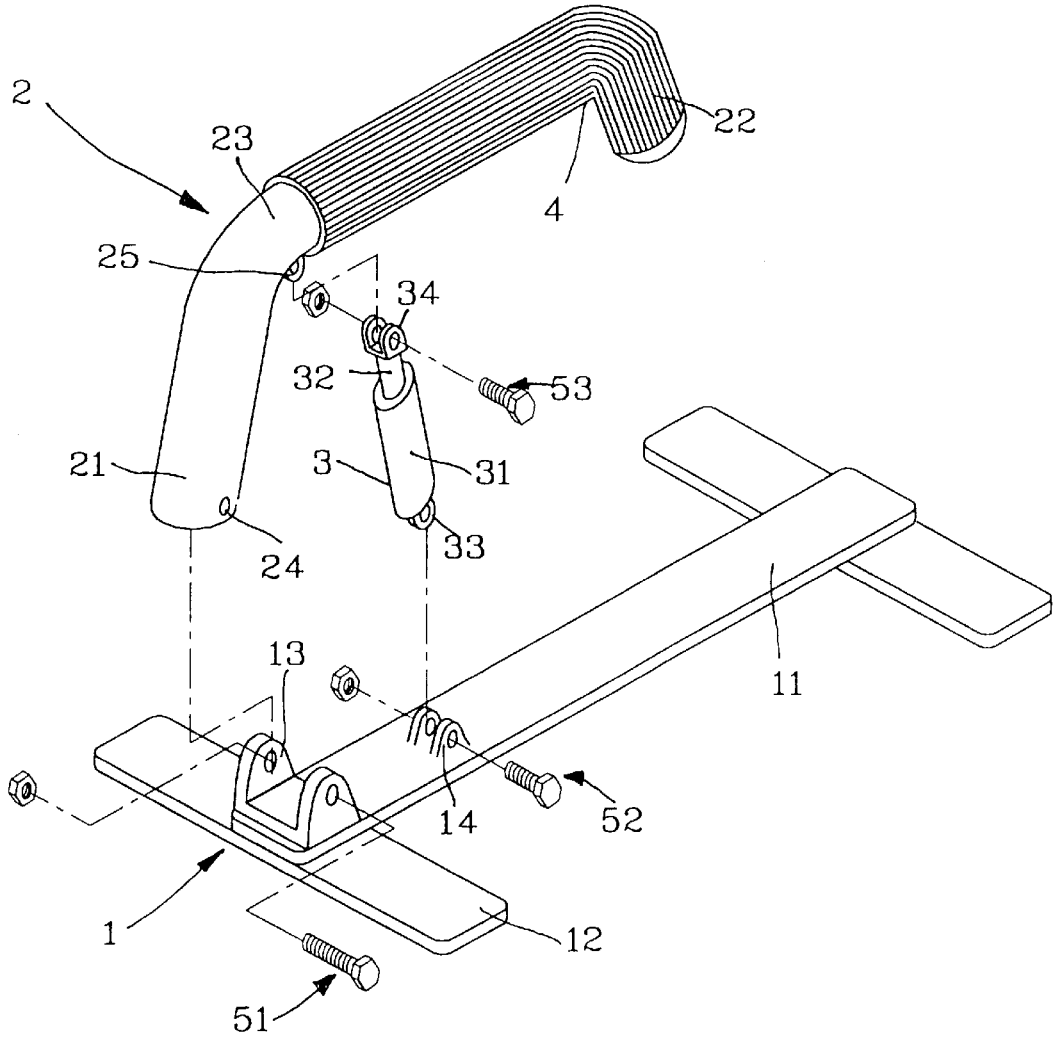
FIG. 1 is an exploded perspective view of the present invention.
Figure 2:
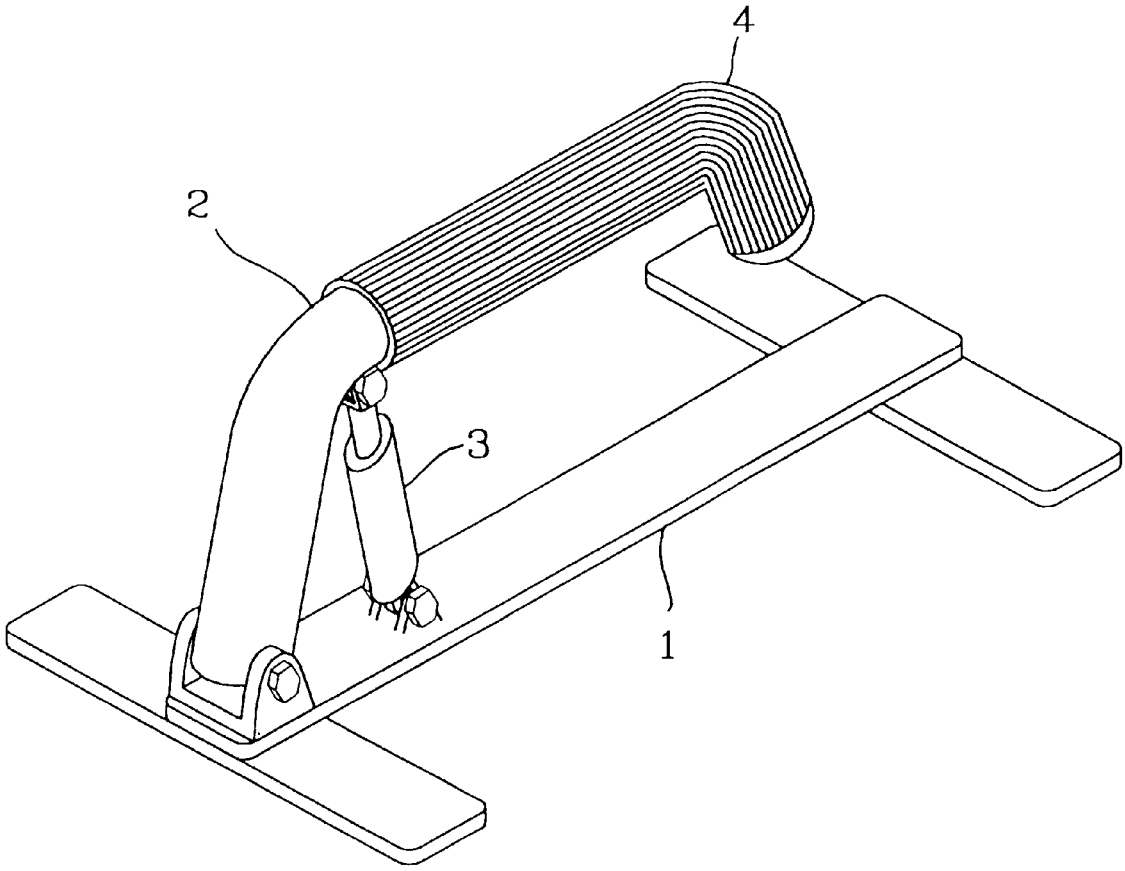
FIG. 2 is an assembled perspective view of the present invention.
Figure 3:
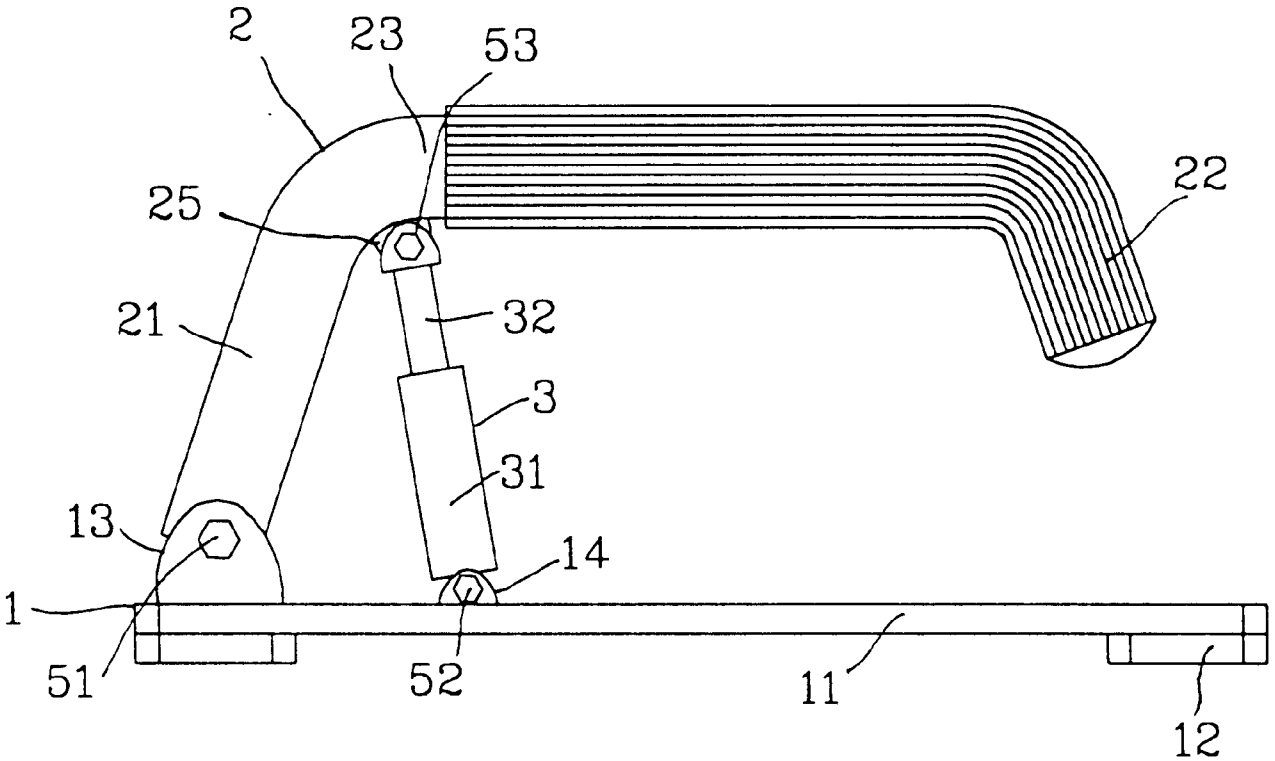
FIG. 3 is an assembled plane view of the present invention.

With reference to FIGS. 1, 2 and 3, the push-up exercise holder of the present invention mainly includes a seat 1, a lever 2 pivotally installed thereon, an elastic buffer element 3 installed between the seat 1 and the lever 2.

The elastic buffer element 3 is a shock absorber and is formed with a pump 31 having a spring (not shown) to resist against a protruding rod 32. The two ends of the pump 31 and the rod 32 are installed with respective connecting pieces 33 and 34.

The seat 1 is an H shape straight piece 11 two ends of which are extended with short pieces 12. The straight piece 11 on the seat has a front end installed with a U shape pivotal seat 13. The two lateral sides of the pivotal seat 13 have pivotal holes. Furthermore, the straight piece 11 has a middle section which is protruded with a connecting piece 14 having a pivotal hole. Thereby, screws 51 can pass therethrough to be connected to the connecting pieces 33 of the pump of the shock absorber.

The lever 2 is a curbed tube with two ends being installed with respective bending portions 21 and 22 and a middle portion being a straight rod 23. The front bending portion 21 has a longer arm which is installed with a pivotal hole 24, and is connected to the pivotal seat 13 by screw 51. The front bending portion 21 of the lever has a bottom protruded with a connecting piece 25 having pivotal holes. Thereby, the shock absorber is connected to the connecting piece 34 of the rod of the shock absorber. In use, a preferred holding sense on the lever 2 can be obtained by adding a soft sleeve 4.

Figure 4:
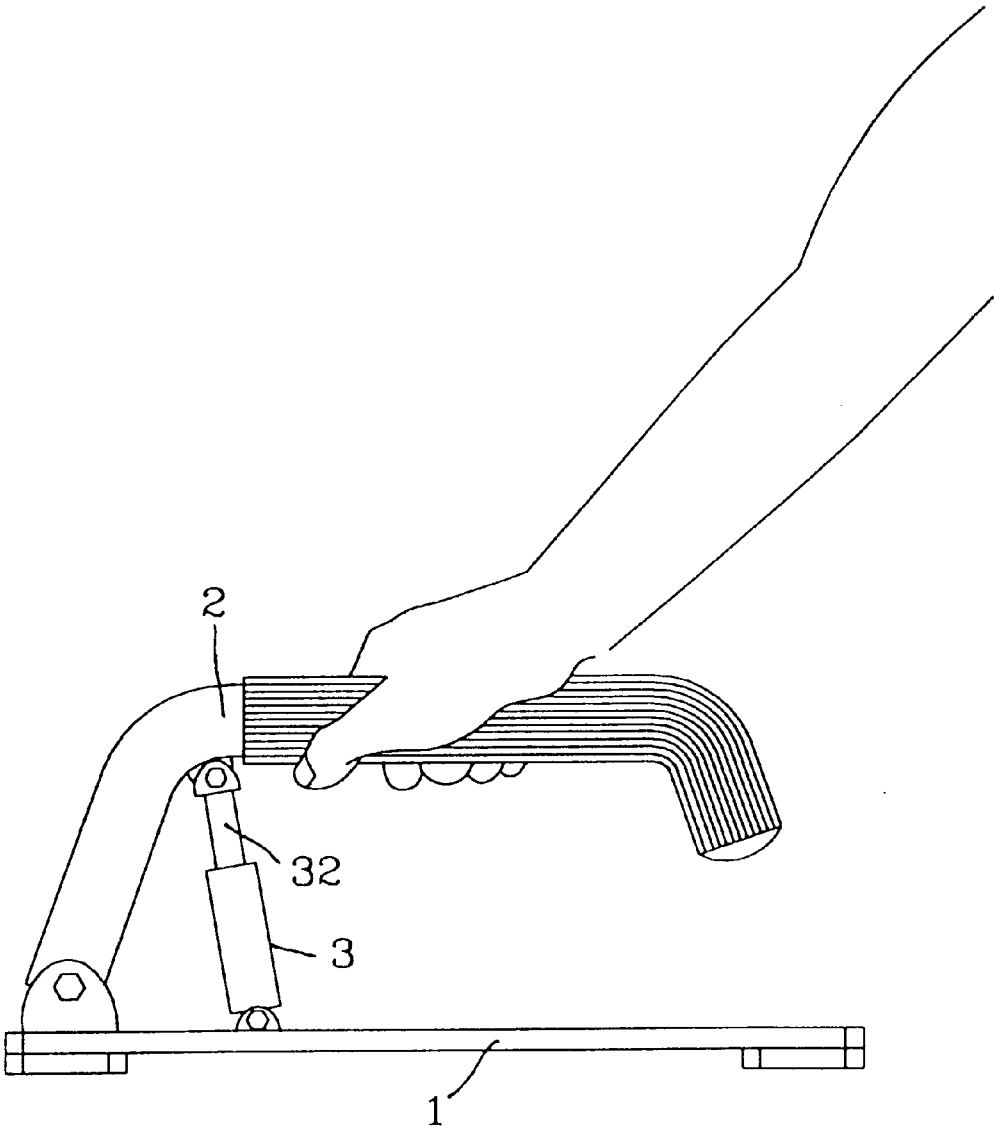
FIG. 4 is a schematic view showing an application of the present invention.
Figure 5:
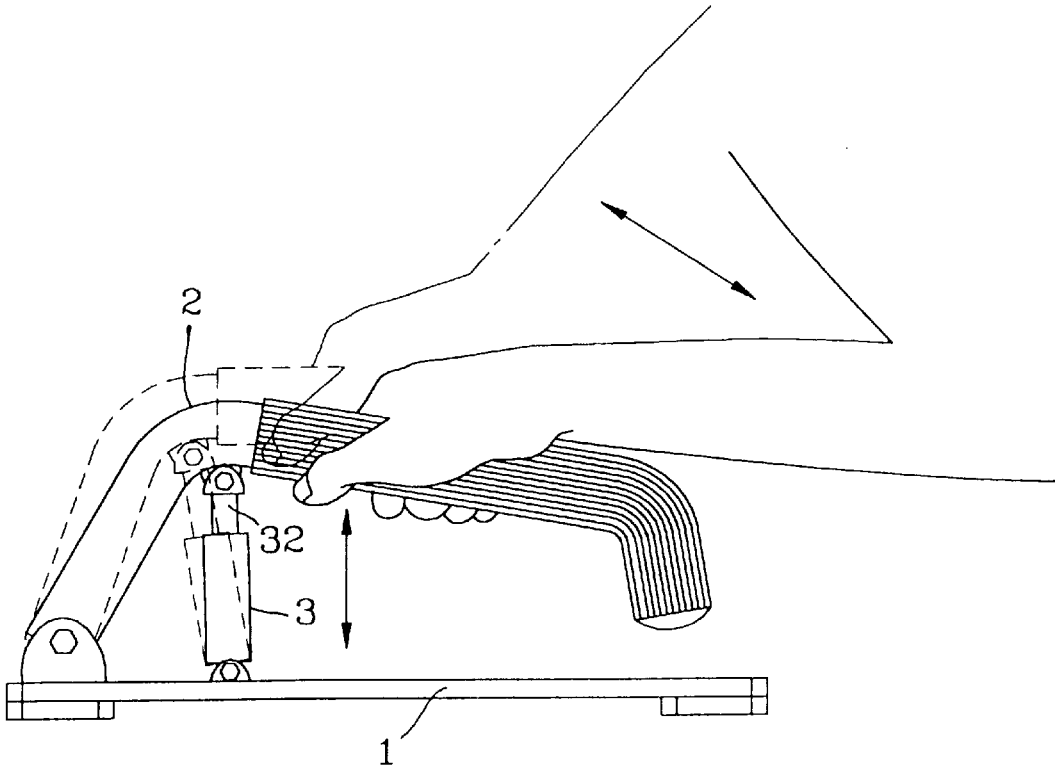
FIG. 5 is a schematic view showing that the present invention generates a buffer effect.

Thereby, With reference to FIGS. 3, 4, and 5, as the present invention has been assembled, the straight rod 23 of the lever 2 can be elevated and is on the seat 1 and parallel to the straight piece 11. The rear bending portion 22 is formed with a notch with the seat 1. In application, as the lever 2 is held, the elastic buffer element 3 between the seat 1 and the rod 2 serves to provide with a proper buffer effect. When the body presses downwards, the rod 32 of the shock absorber will compress, and it is stretched. By a reacting force, the rod 32 restores to the original state. Therefore, the push-up exercise holder will up and down move with the upward and downward movement of the body so as to get a preferred rhythm in exercise.

The above described embodiments are not intended to limit the scope of the present invention, as one skilled in the art can, in view of the present invention, expand such embodiments to correspond with the subject matter of the present invention claimed below. Therefore, all such substitutions and modifications are intended to be embraced within the scope of the invention as defined in the appended claims.

What is claimed is:

1. A push-up exercise holder comprising:

a planar seat having a first surface with a pivotal seat and a first connecting piece extending upwardly therefrom;

a lever having a straight middle portion, and first and second bent opposite ends, the first end being pivotally attached to the pivotal seat, the lever having a second connecting piece extending therefrom;

an elastic buffer element comprising a shock absorber body with a movable rod extending therefrom, an end of the movable rod pivotally attached to one of the first and second connecting pieces and the shock absorber body pivotally connected to the other of the first and second connecting pieces; and the straight middle portion of the lever is substantially parallel to the planar seat when the movable rod of the elastic buffer element is fully extended, and the straight middle portion is adapted to be pushed by a user's hand towards the planar seat, thereby pushing the movable rod into the shock absorber body to transfer compression force from the user to the elastic buffer element.

2. The push-up exerciser of claim 1 further comprising a gripping sleeve covering the middle portion and second end of the lever.

3. The push-up exerciser of claim 1 wherein the seat has an H-shaped configuration.

* * * * *